US006496165B1

(12) United States Patent
Ide et al.

(10) Patent No.: US 6,496,165 B1
(45) Date of Patent: Dec. 17, 2002

(54) DRIVING APPARATUS FOR DRIVING A PLASMA DISPLAY PANEL BASED ON POWER CONSUMED DURING A NON-LIGHT EMITTING PERIOD OF A UNIT DISPLAY PERIOD

(75) Inventors: Shigeo Ide, Yamanashi (JP); Kenichiro Hosoi, Fukuroi (JP); Naruhiro Sato, Fukuroi (JP)

(73) Assignee: Pioneer Corporation, Tokyo (JP)

( * ) Notice: Subject to any disclaimer, the term of this patent is extended or adjusted under 35 U.S.C. 154(b) by 205 days.

(21) Appl. No.: 09/597,094

(22) Filed: Jun. 20, 2000

(30) Foreign Application Priority Data

Jul. 1, 1999 (JP) ..... 11-187907

(51) Int. Cl.[7] ..... G09G 3/28
(52) U.S. Cl. ..... 345/60; 345/63; 345/212
(58) Field of Search ..... 345/60–72, 690, 345/211, 212, 213; 315/169.1, 169.4

(56) References Cited

U.S. PATENT DOCUMENTS 5,956,014 A * 9/1999 Kuriyama et al. ..... 345/690
6,034,656 A * 5/2000 Yamamoto et al. ..... 345/60
6,278,421 B1 * 8/2001 Ishida et al. ..... 345/63
6,326,938 B1 * 12/2001 Ishida et al. ..... 345/63

FOREIGN PATENT DOCUMENTS

JP 6-332397 * 12/1994

* cited by examiner

*Primary Examiner*—Dennis-Doon Chow
*Assistant Examiner*—Amr Awad
(74) *Attorney, Agent, or Firm*—Morgan, Lewis & Bockius LLP

(57) ABSTRACT

A driving apparatus of a plasma display panel which is capable of reducing the scale of the driver itself while limiting power consumed by the plasma display panel. The value of power consumed during a non-light emitting period in one field (frame) period is added to an average luminance level of an input video signal to derive average power consumption, and the power consumed by the plasma display panel is controlled on the basis of the average power consumption.

3 Claims, 6 Drawing Sheets

DRIVING APPARATUS FOR DRIVING A PLASMA DISPLAY PANEL BASED ON POWER CONSUMED DURING A NON-LIGHT EMITTING PERIOD OF A UNIT DISPLAY PERIOD

BACKGROUND OF THE INVENTION

1. Field of the Invention

The present invention relates to a driving apparatus for a plasma display panel.

2. Description of Related Art

In recent years, with the trend of increasing the size of display devices, the need for thinner display devices has increased, and a variety of thin display devices have been brought into practical use. An AC (alternate discharge) type plasma display panel (hereinafter referred to as "PDP") has drawn attention as one of such thin display devices.

The AC type PDP comprises a group of row electrode pairs (sustain electrode pairs) arranged on the inner surface of one of glass substrates opposing each other with a discharge space interposed therebetween, and a group of column electrodes (data electrodes) arranged on the inner surface of the other glass substrate to intersect with the row electrode pairs, and a discharge cell corresponding to one pixel is formed at each of intersections of the electrodes so that the cells are arranged as a whole in a matrix.

In such a PDP, a subfield method is used to drive the PDP to realize gradation representations. In the gradation driving according to the subfield method, one field period is divided into N subfields, in each of which a reset stage, an address stage and a simultaneous light emission sustaining discharge stage are performed in sequence. First, in the reset stage, all discharge cells are simultaneously reset for discharging to initially set all the discharge cell to either "light emitting cells" or "non-light emitting cells." Also, in the address stage, the discharge cells are selectively set to "light emitting cells" or "non-light emitting cells" in accordance with pixel data corresponding to an input video signal. Further, in the simultaneous light emission sustaining discharge stage, only discharge cells which have been set to the "light emitting cells" are repetitively discharged to sustain their discharge light emitting states. A sequence of these operations are performed in each subfield to realize a half-tone luminance display corresponding to the input video signal.

In the half-tone luminance display as mentioned, the number of times the discharge cells are discharged to sustain the light emitting state depends on the weighting applied to each subfield. In addition, the setting of the address stage is relied on to determine whether or not the light emission sustaining discharge is performed or not in each subfield. In this way, a light emitting period and a non-light emitting period are formed in a display period of one field corresponding to an input video signal. In other words, as an input video signal has a higher luminance, the light emitting period occupies a larger proportion within one field period. Conversely, as the input video signal has a lower luminance, the non-light emitting period occupies a larger proportion within one field period.

Here, power consumed by a PDP varies depending on the light emitting period, i.e., the number of "light emitting cells" and the number of times these "light emitting cells" emit light. More specifically, the power consumption becomes minimum when all the discharge cells are set to "non-light emitting cells" and becomes maximum when all the discharge cells are set to "light emitting cells." For this reason, a power supply circuit for use in driving a PDP should be set to have its current supply capability which is assumed to be required when all the discharge cells are set to "light emitting cells."

However, since an average luminance level of a video signal is typically about 30 percent of a maximum luminance level, the power supply circuit has an excessive margin in the current supply capability in a normal video display state. Thus, the conventional PDP driver has a problem in that the power supply circuit itself is large in scale due to the surplus current supply capability possessed thereby.

OBJECT AND SUMMARY OF THE INVENTION

The present invention has been made to solve the problem mentioned above, and an object of the present invention is to provide a driving apparatus of a plasma display panel which is capable of reducing the scale of the driver itself while suppressing the power consumption.

The present invention provides a driving apparatus of a plasma display panel having a plurality of discharge cells arranged in matrix, wherein a unit display period is divided into a light emitting period and a non-light emitting period in accordance with an input video signal for driving the plasma display panel, such that the discharge cells are driven to repeatedly emit light only during the light emitting period to provide a display at a half-tone luminance. The driver comprises power consumption control means for adding a value corresponding to power consumed during the non-light emitting period to an average luminance level of the input video signal to control power consumption of the plasma display panel based on the average power consumption.

DETAILED DESCRIPTION OF THE EMBODIMENTS

Embodiments of the present invention will hereinafter be described with reference to the accompanying drawings.

Figure 1:
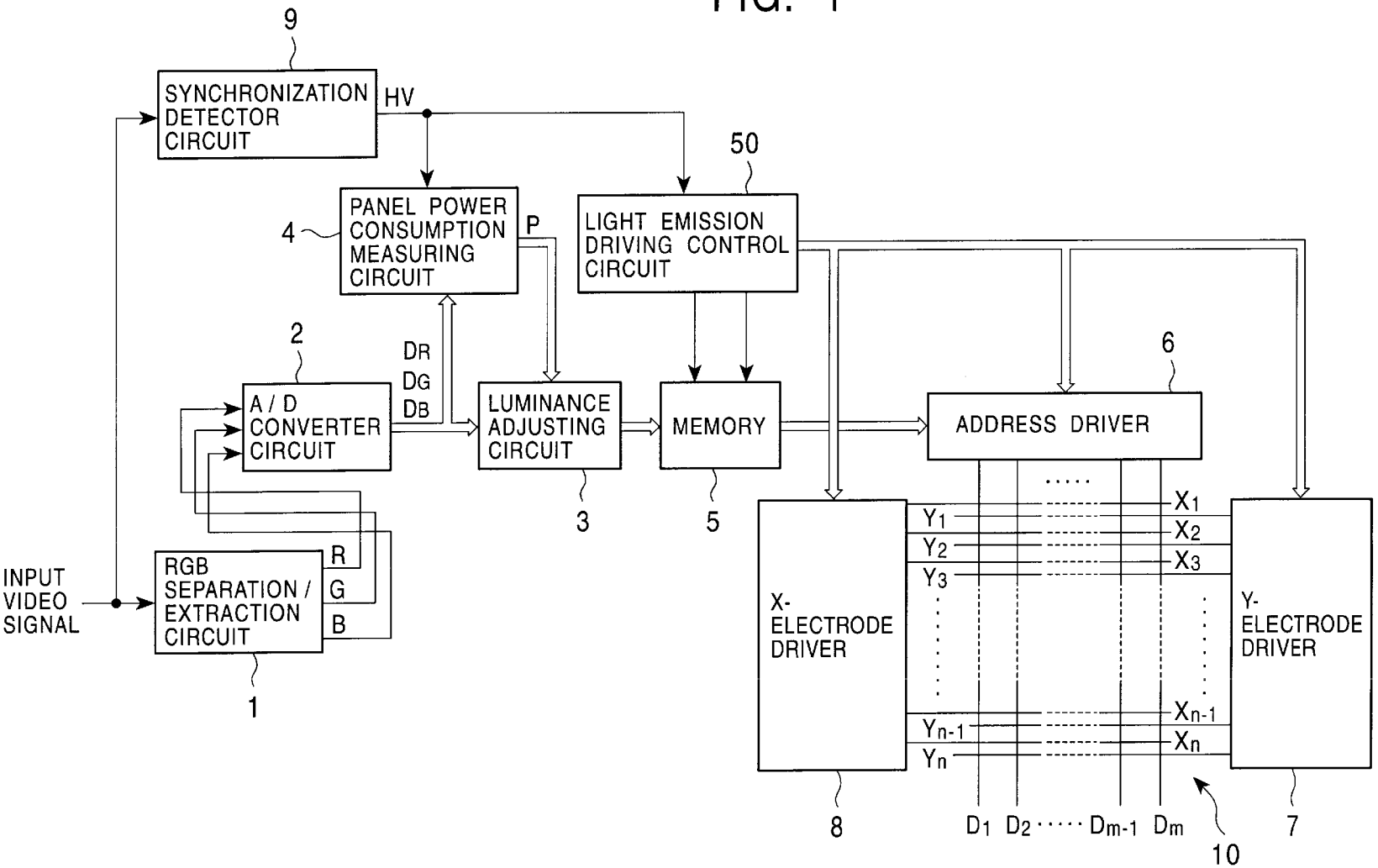
FIG. 1 is a block diagram illustrating the configuration of a plasma display device equipped with a driver according to the present invention.

FIG. 1 illustrates the configuration of a plasma display device equipped with a driver according to the present invention.

As illustrated in FIG. 1, the plasma display device generally comprises a PDP 10 functioning as a plasma display panel, and a driver unit composed of a variety of functional modules.

The PDP 10 comprises m column electrodes $D_1$–$D_n$ as address electrodes, and n row electrodes $X_1$–$X_n$ and row electrodes $Y_1$–$Y_n$ which are arranged orthogonal to each of these column electrodes. In this structure, a pair of a row electrode X and a row electrode Y forms a row electrode corresponding to one row in the PDP 10. The column electrodes D and the row electrodes Y, Y oppose each other with an intervening discharge space, and are covered with respective dielectric layers. A discharge cell C corresponding to one pixel is formed at the intersection of each low electrode pair and each column electrode. Specifically, the PDP 10 is formed with (nxm) discharge cells, arranged in a matrix, which include a discharge cell $C_{1,1}$ belonging to the first row and first column to a discharge cell $C_{n,m}$ belonging to an $n^{th}$ row and an $m^{th}$ column.

An input video signal for displaying a video on the PDP 10 as described above is supplied to an RGB separation/extraction circuit 10 and to a synchronization detector circuit 9, respectively.

The RGB separation/extraction circuit 1 separates a red component signal R, a green component signal G and a blue component signal B from the input analog video signal, extracts each of the separated signals, and supplies them to an A/D converter circuit 2. The A/D converter circuit 2 samples each of these analog red component signal R, green component signal G and blue component signal B to convert them to pixel data $D_R$, $D_G$, $D_B$, respectively, each of which is comprised, for example, of six bits, corresponding to each pixel. The pixel data $D_R$, $D_G$, $D_B$ are supplied to a luminance adjusting circuit 3 and a panel power consumption measuring circuit 4, respectively.

The synchronization detector circuit 9 detects a horizontal synchronization signal and a vertical synchronization signal from the input video signal, and supplies the panel power consumption measuring circuit 4 and a light emission driving control circuit 50 with a synchronization detecting signal HV indicative of the detection timing.

The panel power consumption measuring circuit 4 measures an average value of power consumed by each of the discharge cells in the PDP 10, and supplies the average value to the luminance adjusting circuit 3 as average power consumption P.

Figure 2:
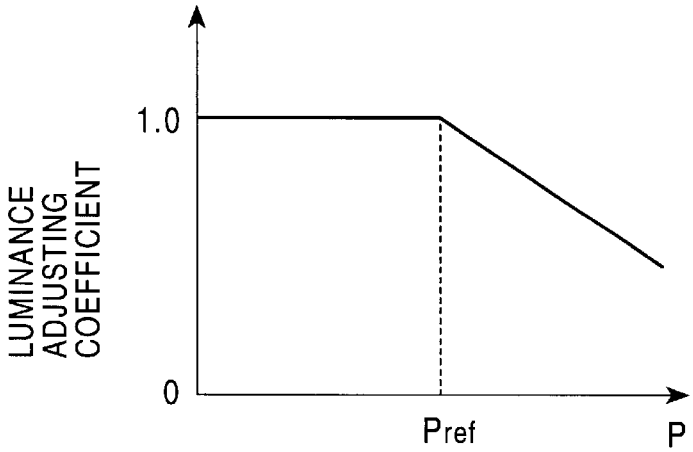
FIG. 2 is a graph showing a change in a luminance adjusting coefficient for varying average power consumption P.

The luminance adjusting circuit 3 multiplies the pixel data $D_R$, $D_G$, $D_B$ supplied from the A/D converter circuit 2 by a luminance adjusting coefficient in accordance with the average power consumption as shown in FIG. 2 to derive luminance adjusted pixel data $DC_R$, $DC_G$, $DC_B$ which are then supplied to a frame memory 5. More specifically, when the average power consumption P is smaller than a predetermined reference power consumption $P_{ref}$, the luminance adjusting circuit 3 supplies the frame memory 5 with each of the pixel data $D_R$, $D_G$, $D_B$ as they are as the luminance adjusted pixel data $DC_R$, $DC_G$, $DC_B$. On the other hand, when the average power consumption P is larger than the predetermined reference power consumption $P_{ref}$, the luminance adjusting circuit 3 adjusts the pixel data $D_R$, $D_G$, $D_B$ to reduce their luminance levels with the luminance adjusting coefficient which provides a higher attenuation factor as the average power consumption P is larger. The reference power consumption $P_{ref}$ may be, for example, a power level which is calculated by adding a predetermined margin to 30 percent of a power value consumed by the PDP when a luminance represented by the pixel data D is maximum.

The frame memory 5 stores each of the luminance adjusted pixel data $DC_R$, $DC_G$, $DC_B$ in response to a write signal supplied thereto from the light emission driving control circuit 50. Here, as one frame (n rows and m columns) has been stored, the frame memory 5 divides each of the luminance adjusted pixel data $DC_R$, $DC_G$, $DC_B$ into respective bit figures to reorganize (m) data groups of the same bit figures for each row. The resulting bit groups are supplied to an address driver 6 as pixel driving data bits $DG_1$–$DG_m$.

Figure 3:
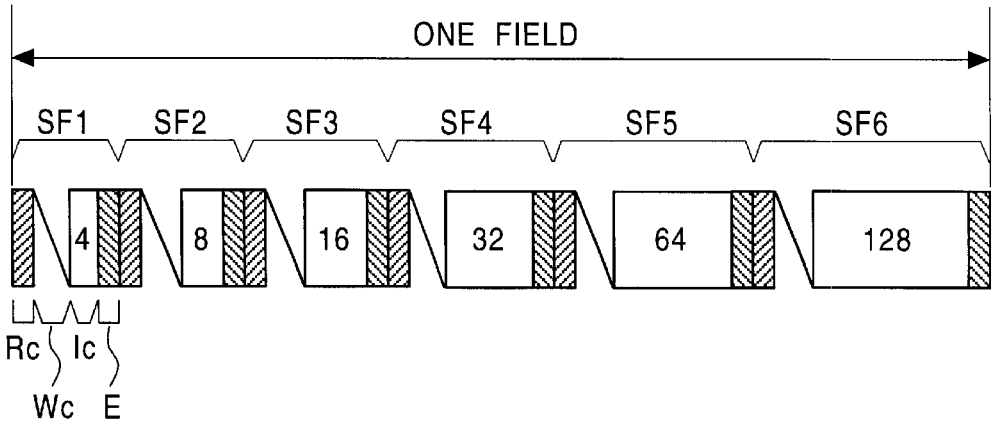
FIG. 3 is a diagram illustrating an exemplary light emission driving format.

The light emission driving control circuit 50 supplies a variety of timing signals to each of the address driver 6, a Y-electrode driver 7 and an X-electrode driver 8 in order to control the driving of the PDP 10 to emit light in accordance with a light emission driving format which employs subfields, for example, as illustrated in FIG. 3.

It can be seen in FIG. 3 that in the illustrated light emission driving format, a display period within one field is divided into six subfields SF1–SF6, each of which includes a reset stage Rc, an address stage Wc, a simultaneous light emission discharge sustaining stage Ic, and an erasure stage E.

Figure 4:
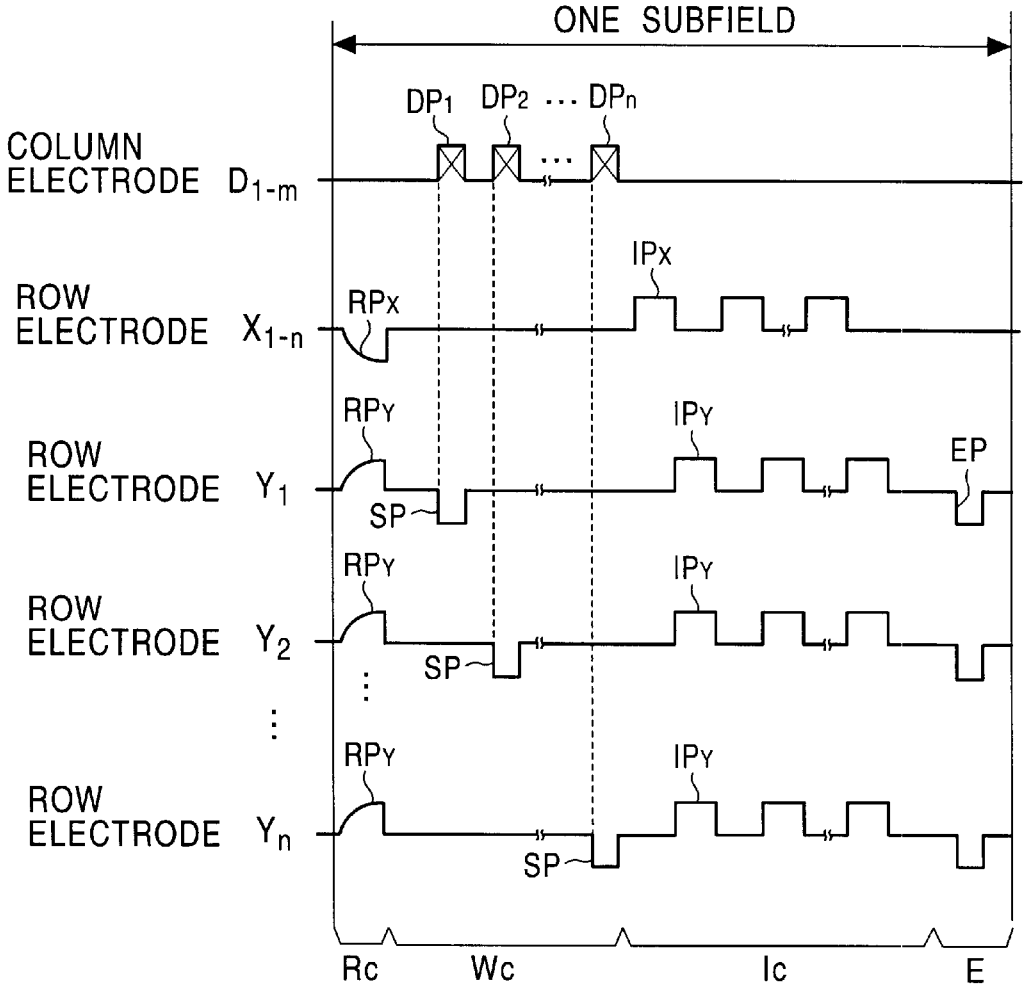
FIG. 4 are waveform diagrams showing application timings at which a variety of driving pulses are applied to a PDP 10 within one subfield.

FIG. 4 shows application timings (within one subfield) at which each of the address driver 6, the Y-electrode driver 7 and the X-electrode driver 8 applies a variety of driving pulses to the column electrodes D and the row electrodes X, Y of the PDP 10 in accordance with a variety of timing signals supplied from the light emission driving control circuit 50.

First in the reset stage Rc, the Y-electrode driver 7 applies the row electrodes $X_1$–$X_n$ with a reset pulse $RP_X$ of positive polarity. Simultaneously with this, the X-electrode driver 8 applies the row electrodes $Y_1$–Yn with a reset pulse $RP_Y$ of negative polarity. The simultaneous application of the reset pulses $RP_X$, $RP_Y$ causes all discharge cells in the PDP 10 to be reset for discharging, resulting in predetermined wall charges formed uniformly in the respective discharge cells. In this way, all the discharge cells in the PDP 10 is once set initially to "light emitting cells."

Next, in the address stage Wc, the address driver 6 converts each of the pixel driving data bits $DG_1$–$DG_m$ supplied from the frame memory 5 as described above to m pixel data pulses having voltages corresponding to respective logical levels. In this event, the address driver 6 generates a pixel data pulse at a high voltage when a pixel driving data bit DG is for example at logical level "1," and a pixel data pulse at a low voltage (zero volt) when the pixel driving data bit DG is at logical level "0." The address driver 6 assigns these m pixel data pulses, i.e., pixel data pulses for one row as a pixel data pulse group DP, and first applies column electrodes $D_1$–$D_m$ with a pixel data pulse group $DP_1$ corresponding to the first row; and next applies the column electrodes $D_1$–$D_m$ with a pixel data pulse group $DP_2$ corresponding to the second row. Further, in a similar manner, the address driver 6 sequentially applies column electrodes $D_1$–$D_m$ with pixel data pulse groups $DP_3$–$DP_n$ corresponding to the third to $n^{th}$ rows. Here, the X-electrode driver 8 generates a scan pulse SP of negative polarity at the same timing as the application timing of each of the pixel data pulse groups DP as mentioned above, and sequentially applies the scan pulse SP to the row electrodes $Y_1$–$Y_n$, as illustrated in FIG. 4. In this event, discharge (selective erasure discharge) occurs only in a discharge cell positioned at the intersection of a "row" applied with the scan pulse SP and a "column" applied with the high voltage pixel data pulse, so that the wall charge remaining in the discharge cell is selectively erased. The selective erasure discharge causes the discharge cell initialized to a "light emitting cell" state in the reset stage Rc to proceed to a "non-light emitting cell." It should be noted that the discharge does not occur in each of discharge cells belonging to a "column" applied with the low voltage pixel data pulse so that these discharge cells are maintained in the initialized state in the reset stage Rc, i.e., the "light emitting cell" state.

Next, in the simultaneous light emission discharge sustaining stage Ic, the Y-electrode driver 7 and the X-electrode driver 8 apply row electrodes $X_1$–$X_n$, $Y_1$–$Y_n$ alternately with the sustain pulses $IP_X$, $IP_Y$ of positive polarity. The number of times (duration) these sustain pulses $IP_X$, $IP_Y$ are applied within the simultaneous light emission discharge sustaining stage Ic is set for each subfield.

For example, as illustrated in FIG. 3, when the number applications of the sustain pulses in the subfield SF1 is "4," the sustain pulses are applied the following numbers of times in the subsequent subfields:

SF1: 4
SF2: 8
SF3: 16
SF4: 32
SF5: 64
SF6: 128

By thus applying the sustain pulses IP, discharge cells having the wall charges still remaining in the address stage Wc, i.e., the "light emitting cells" discharge to maintain emitted light each time they are applied with the sustain pulses $IP_X$, $IP_Y$ to maintain their light emitting state the number of times (duration) assigned to each subfield.

Finally, in the erasure stage E, the Y-electrode driver 7 applies the row electrodes $Y_1$–$Y_n$ with an erasure pulse EP of negative polarity as illustrated in FIG. 4 to cause all the discharge cells to collectively discharge for erasure, thereby erasing the wall charges still remaining in the respective discharge cells.

In this event, the number of sustain pulses IP applied in the simultaneous light emission discharge sustaining stage corresponds to the weighting applied to each subfield as described above, and in each subfield, whether to produce the light emission sustain discharge or not depends on how the address stage is set. In this way, a light emission period and a non-light emission period are formed in a display period of one field corresponding to an input video signal.

Therefore, by performing the foregoing operation in one subfield in each of the subfields SF1–SF6 as illustrated in FIG. 4, 64 levels of half-tone display can be accomplished, where the total number of light emission sustaining discharges performed in one field, i.e., the light emission period in one field corresponding to each level is defined in the following proportion:

(0, 4, 8, 12, 16, 20 . . . 248, 252}

In this event, while the maximum luminance is produced and therefore the largest power is consumed when the total number of light emission sustaining discharges is "252," an average luminance in a normal video display is merely about 30 percent of the maximum luminance. Also, it is known that a gradation change visible by a human in a high luminance display is slow as compared with that in a low luminance display.

Bearing this fact in mind, in the present invention, the panel power consumption measuring circuit 4 first measures average power consumption P consumed by the PDP 10 when one field (frame) is displayed on the basis of image data $D_R$, $D_G$, $D_B$.

Figure 5:
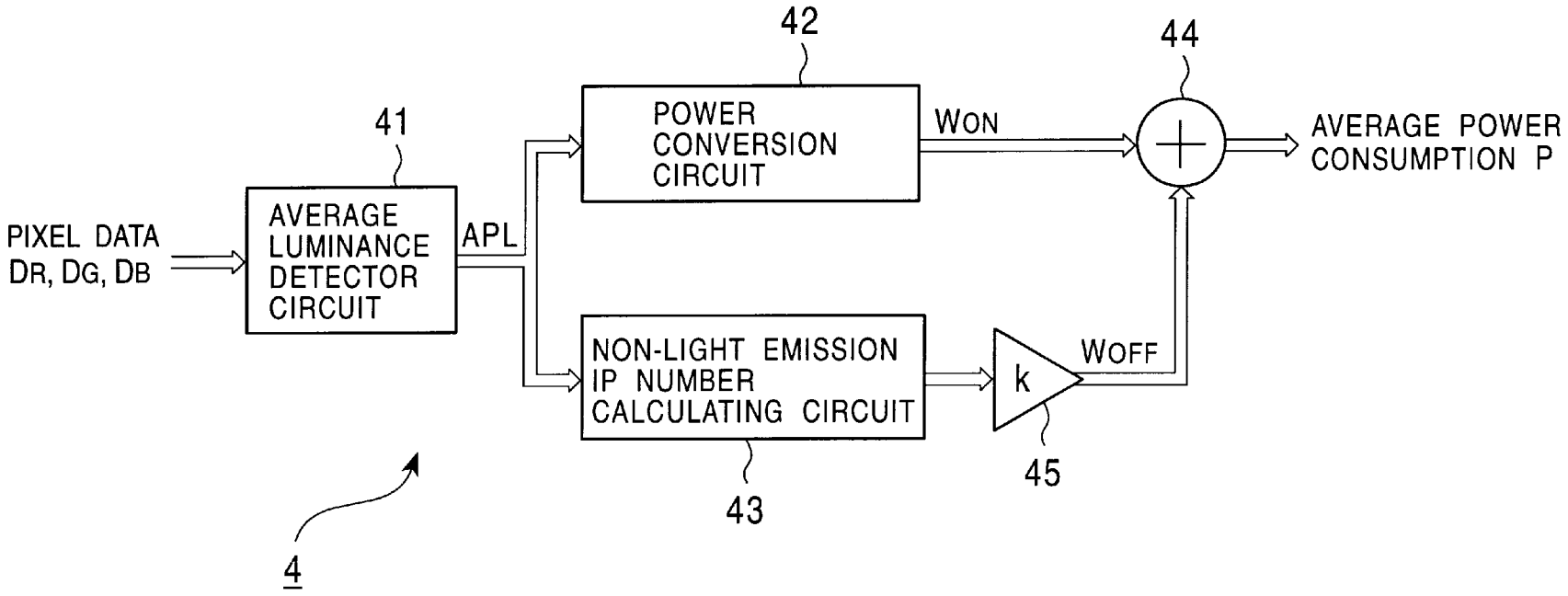
FIG. 5 is a block diagram illustrating an example of the internal configuration of a panel power consumption measuring circuit 4.

FIG. 5 illustrates the internal configuration of the panel power consumption measuring circuit 4.

Referring specifically to FIG. 5, an average luminance detector circuit 41 finds an average luminance level per discharge cell based on each of the pixel data $D_R$, $D_G$, $D_B$, and supplies the resultant value to a power conversion circuit 42 and to a non-light emission sustain pulse number calculating circuit 43 as an average luminance level APL.

The power conversion circuit 42 converts the average luminance level APL to the value of power which is consumed when a display is produced at a luminance indicated by the average luminance level APL, and supplies the power value to an adder 44 as light emission power consumption $W_{ON}$. When a display is produced at the luminance indicated by the average luminance level APL, the non-light emission sustain pulse number calculating circuit 43 calculates the total number of sustain pulses IP applied in each of subfields SF belonging to a non-light emission period within the subf ields SF1–SF6 which comprise one field (frame) period, and supplies the calculated total number to a coefficient multiplier 45.

For example, according to the light emission driving format as illustrated in FIG. 3, the total number of the sustain pulses IP applied in one field amounts to 252. In this event, for displaying, for example, a luminance "29" within 64 possible levels of luminance in a range of "0" to "63" available by 6-bit pixel data, the sustain discharges must be performed 116 times in one field period. More specifically, 116 of 252 sustain pulses IP are applied in the simultaneous light emission sustain discharge stage Ic in each of subfield belonging to the light emission period, and the remaining 136 sustain pulses IP are applied in the simultaneous light emission sustain discharge stage Ic in each of subfield belonging to the non-light emission period. In this event, the power consumption results from the sustain pulses IP which are merely applied to the row electrodes even without contributing to "light emission." Thus, the non-light emission sustain pulse number calculating circuit 43 calculates the total number of the sustain pulses IP which are applied in the simultaneous light emission sustain discharge stages Ic in all subfields belonging to the non-light emitting period as a factor of power consumption during the non-light emitting period in one field period.

The coefficient multiplier 45 multiplies the number of sustain pulses IP applied during the non-light emitting period by unit power k consumed by applying one sustain pulse IP to derive non-light emission power consumption $W_{OFF}$ during the non-light emitting period which is supplied to the adder 44.

The adder 44 adds the light emission power consumption WON and the non-light emission power consumption $W_{OFF}$ to derive final average power consumption P for outputting.

Here, in the present invention, the luminance adjusting circuit 3 forcibly attenuates the values of the respective pixel data $D_R$, $D_G$, $D_B$ when a display is produced at a relatively high luminance at which the average power consumption P derived by the panel power consumption measuring circuit 4 is larger than predetermined reference power consumption $P_{ref}$. Although this operation causes the actually displayed luminance to be slightly lower than the luminance indicated by the pixel data D, such a slight reduction in luminance will not result in any problem because a gradation change visible by a human in a high luminance display is slow as compared with that in a low luminance display, as previously mentioned.

It is therefore possible to reduce the power consumption by the amount corresponding to the attenuated luminance level at the stage of the pixel data D as described above and accordingly employ a power supply circuit (not shown) having a lower current supply capability for driving the PDP 10.

In the foregoing embodiment, the panel power consumption measuring circuit 4 derives the average power consumption P from the average luminance level APL detected by the average luminance detector circuit 41 by a combination of the power conversion circuit 42, the non-light emission sustain pulse number calculating circuit 43, the adder 44 and the coefficient multiplier 45. The panel power consumption measuring circuit 4, however, is not limited to such a specific configuration.

For example, the value possibly taken as the average luminance level APL is a limited one determined by the number of bits constituting the pixel data D, and the average luminance level APL is in a one-to-one relationship with the average power consumption P. Bearing this relation in mind, the values of the average power consumption P are previously calculated for all possible average luminance levels APL, and are stored in a memory such that each of the average power consumption values P corresponding to a particular average luminance level APL can be read by using the average luminance level APL as the address. In other words, the panel power consumption measuring circuit 4 can be implemented by the average luminance detector circuit 41 and the memory which is addressed by the average luminance level APL detected by the average luminance detector circuit 41.

Also, while in the foregoing embodiment, the luminance adjusting circuit 3 is used to limit the luminance in a high luminance display at the stage of the pixel data D, the limitation on the luminance may be made by reducing the number of sustain pulses IP to be applied in one field (frame), instead of using the luminance adjusting circuit 3.

Figure 6:
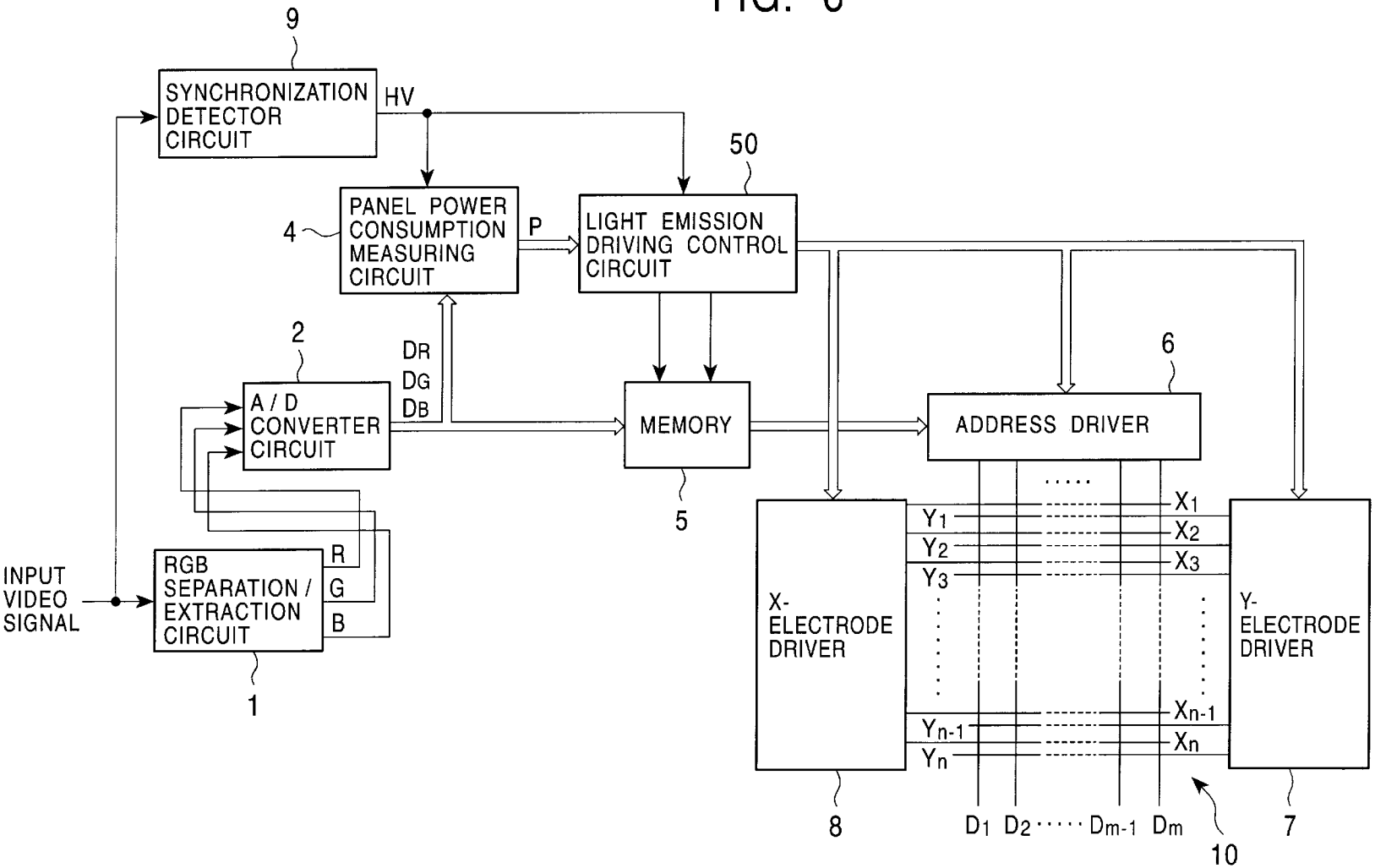
FIG. 6 is a block diagram illustrating the configuration of a plasma display device equipped with another embodiment of the driver according to the present invention.

FIG. 6 illustrates the configuration of a plasma display device equipped with a driver according to another embodiment of the present invention which has been made in view of the foregoing alternative.

Specifically, the plasma display device illustrated in FIG. 6 excludes the luminance adjusting circuit 3 shown in FIG. 1, and each of pixel data $D_R$, $D_G$, $D_B$ produced by an A/D converter 2 is supplied to a panel power consumption measuring circuit 4 and to a frame memory 5, such that average power consumption P measured by the panel power consumption measuring circuit 4 is supplied to a light emission driving control circuit 50. Since the remaining configuration in FIG. 6 is identical to that in FIG. 1 except for the above differences, description thereon is omitted.

Figure 7:
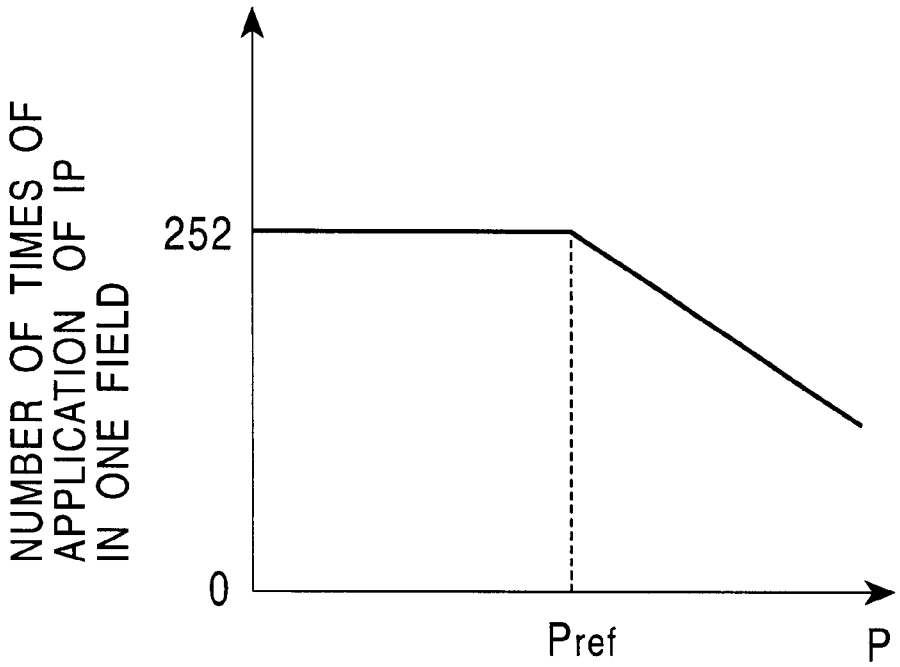
FIG. 7 is a graph showing a change in the number of times a sustain pulse IP is applied, for the varying average power consumption P.

The light emission driving control circuit 50 drives the light emission in accordance with the light emission driving format as illustrated in FIG. 3 by setting the number of sustain pulses IP applied in one field (frame) period to 252, as shown in FIG. 7, when the average power consumption P is smaller than the aforementioned reference power consumption $P_{ref}$. Conversely, when the average power consumption P is larger than the reference power consumption $P_{ref}$, the light emission driving control circuit 50 drives the light emission with a reduced number of sustain pulses IP applied in one field (frame) period by a number which is larger as the average power consumption P is increased, as illustrated in FIG. 7.

Likewise, the driving scheme as described can reduce the power consumption by slightly reducing the actually displayed luminance from a luminance indicated by pixel data D when a display is produced at a relatively high luminance.

As described above in detail, in the present invention, the value of power consumed during a non-light emitting period in one field (frame) period is added to an average luminance level of an input video signal to derive an average power consumption, and the power consumed by the plasma display panel is controlled on the basis of the average power consumption. In this event, the input video signal is attenuated, or the number of times of sustain discharges is reduced, when the average power consumption is larger than the predetermined reference power consumption, to reduce the power consumption, thereby making it possible to employ a power supply circuit of smaller scale.

What is claimed is:

1. A driving apparatus for a plasma display panel having a plurality of discharge cells arranged in a matrix, wherein a unit display period for each of said discharge cells is divided into a light emitting period and a non-light emitting period in accordance with an input video signal for driving said plasma display panel, such that said discharge cells are driven to repeatedly emit light only during said light emitting period to provide a display at a half-tone luminance, said driver comprising:

power consumption control means for obtaining a first electric power consumption value corresponding to light emissions by said input video signal and a second electric power consumption value representing electric power consumption by sustaining pulses that are applied without causing light emissions, based on an average luminance level of said input signal and the number of sustain pulses applied in said non-light emitting period, adding said first and second electric power consumption values to obtain an average power consumption, and controlling power consumption of said plasma display panel based on said average power consumption.

2. A driving apparatus of a plasma display panel according to claim 1, wherein said power consumption control means attenuates said input video signal when said average power consumption is larger than a predetermined reference power consumption.

3. A driving apparatus of a plasma display panel according to claim 1, wherein said power consumption control means reduces the number of times said discharge cells are driven to repeatedly emit light during said light emitting period when said average power consumption is larger than said predetermined reference power consumption.

* * * * *